US007716760B1

(12) United States Patent
Alaback

(10) Patent No.: US 7,716,760 B1
(45) Date of Patent: May 18, 2010

(54) BABY CRIB PAD WITH LOWER OPENINGS

(76) Inventor: Elizabeth Alaback, 2629 S. Trenton, Tulsa, OK (US) 74114

( * ) Notice: Subject to any disclaimer, the term of this patent is extended or adjusted under 35 U.S.C. 154(b) by 0 days.

(21) Appl. No.: 12/137,992

(22) Filed: Jun. 12, 2008

(51) Int. Cl.
*A47D 7/00* (2006.01)

(52) U.S. Cl. ..... 5/93.1; 5/424; 5/425; 5/663; 5/946

(58) Field of Classification Search ..... 5/424, 5/425, 946, 93.1, 100, 663
See application file for complete search history.

(56) References Cited

U.S. PATENT DOCUMENTS

| | | | | |
|---|---|---|---|---|
| 2,994,889 | A | 8/1961 | Oblander | |
| 3,018,492 | A | 1/1962 | Rosen | |
| 4,215,446 | A | 8/1980 | Mahoney | |
| 4,767,419 | A | 8/1988 | Fattore | |
| 5,241,718 | A | 9/1993 | Pope | |
| 5,437,071 | A | 8/1995 | Feigenbaum | |
| 5,778,456 | A | 7/1998 | Schimmel | |
| 6,055,690 | A | 5/2000 | Koenig | |
| 6,131,216 | A * | 10/2000 | Pine | 5/93.1 |
| 6,170,101 | B1 | 1/2001 | McCloud | |
| 6,178,573 | B1 | 1/2001 | Wagner et al. | |
| 6,401,281 | B1 | 6/2002 | Younge | |
| 6,438,775 | B1 | 8/2002 | Koenig | |
| 6,564,403 | B1 | 5/2003 | Titus | |
| 6,681,421 | B2 | 1/2004 | Carroll | |
| 6,684,437 | B2 | 2/2004 | Koenig | |
| 6,772,457 | B1 * | 8/2004 | Alaback | 5/93.1 |

* cited by examiner

*Primary Examiner*—Peter M Cuomo
*Assistant Examiner*—Nicholas Polito
(74) *Attorney, Agent, or Firm*—Molly D. McKay

(57) ABSTRACT

A baby crib bumper pad formed from abutting tightly padded segments. Each segment provided with pairs of cooperating vertical flaps that extend around balusters of the baby crib and are tied together on the outside of the crib via short tie fasteners provided on the vertical flaps to secure the segments to the crib. A lower border on each segment is a continuously repeating series of u-shaped crescents that touch each other so that longer portions of the crescents rest on and support the segments above the crib mattress and shorter portions of the crescents form lower openings with the crib mattress. The lower openings permit air to flow between the inside and outside of the crib, thereby preventing the baby from being strangled or suffocated by the pad and helping to prevent SIDS.

14 Claims, 2 Drawing Sheets

BABY CRIB PAD WITH LOWER OPENINGS

BACKGROUND OF THE INVENTION

1. Field of the Invention

The present invention relates to a baby crib pad with air gaps for use on a baby crib for the purpose of protecting a baby from bumping against the balusters of a baby crib while eliminating the danger of the baby being strangled or suffocated by the pad and lessening the possibility of sudden infant death syndrome.

2. Description of the Related Art

The current advice of most pediatricians is that mothers should not use any type of pads in their baby cribs. This advice is given because of several dangers that the traditional crib pads present to babies. A first threat is that the pad or the pad's fastening straps may become wound around the baby's neck and strangle the baby. A second threat is that the baby could roll so that its face was against the pad with both its mouth and nose obstructed by the pad and thereby suffocating the baby. Also, mothers who have both a baby and a toddler worry that the toddler might accidentally dislodge the pad so that the pad falls into the crib on top of the baby, and somehow cover the baby's face and suffocating the baby. Still another danger with use of current crib pads is that many are not tightly secured to the balusters of the crib and the baby can get its head wedged between the pad and the balusters and can be suffocated or strangled.

However, without any type of padding in use on the balusters of baby cribs, babies are in danger of striking their bodies against the balusters and becoming injured. And without the use of some type of pad on the crib, babies often extend their arms or legs between the balusters where the appendage can become stuck and require an adult to free the appendage. Some older types of cribs have balusters that are spaced too far apart and a baby can actually get its head through the opening between adjacent balusters when there is no pad to prevent this, resulting in the child being choked.

Another problem with current pads for baby cribs is that they are generally secured loosely at only a few points to the crib so that a baby can crawl up between the pad and the crib and suffocate.

Still a further problem with current pads is that they prevent air from moving freely into and out of the crib in the area near the surface of the mattress where the baby is laying. The heat buildup and buildup of carbon dioxide and lack of oxygen resulting from lack of air circulation has been cited as possible contributing factors to the tragic problem of sudden infant death syndrome or SIDS.

There have been attempts to address this problem. One patent that attempts to address this problem is U.S. Pat. No. 6,13,216 issued to MacDonald Pine on Oct. 17, 2000. The Pine patent teaches some desirable features in a crib pad, such as various types of air openings provided in a crib pad and also ties to hold the pad to the crib's balusters. However, the air gaps taught by Pine, and specifically the embodiment illustrated in FIG. 5 of that patent, do not have openings that are large enough in proportion to the pad area to prevent possible suffocation of a baby. The openings shown in that patent are half circles cut out of the lower portion of the pad, but the cut out half circles are not continuous in that the cut out portion of one half circle does not continue from its adjacent cut out half circle. Instead there is a distance between the cut outs that appears to be larger than the width of the cut outs themselves. This is due in part to the wide spacing of the cut outs and in part to the orientation of the cut outs which are of an inverted u-shape. The present invention improves over this design by making the lower portion of the pad a continuously repeating series of u-shaped crescents with the junction of the crescents forming the openings with the crib mattress, spacing the crescents so that they join each other in as continuous repeating fashion so that the openings formed between the crescent are closer together. Preferably the spacing of the crescents coincides with the spacing of the balusters on the crib. This arrangement of a series of continuously repeating u-shaped crescents on the pad insures larger proportions of opening area to pad area at the surface of the crib mattress. This larger proportion of opening area to pad area provides for better air flow, less heat retention within the crib and lessens the possibility that a baby could have both its mouth and nose simultaneously obstructed by the pad and the potential for sudden infant death syndrome or SIDS.

The present invention addresses these problems by providing a pad that consists of a plurality of tightly padded segments with each padded segment provided with one or more cooperating pairs of vertical flaps secured to the back side of the segments. Each vertical flap is provided with at least one tie fastener that attach around one or more of the balusters of the crib on the outside of the baby crib and ties in a knot with a tie fastener on a cooperating vertical flap as a means of securing the segments to the crib. The padded segments are tall enough so that a baby will not be able to reach the tie fasteners from within the crib. Also, the tie fasteners are specifically designed to be short so that they are long enough to allow an adult to tie them into a knot to secure the segment to the crib's balusters, but sufficiently short so that the baby will not be in danger of having the tie fasteners become wound around the baby's neck and strangling the baby. Because the tie fasteners are tied into a knot, a toddler would find it difficult to untie them from the outside of the crib.

The padded portion of the segments is tightly padded so that it stands erect against the balusters when tied thereto. The lower border of the padded portion of the segments is formed into a repeating compact crescent shield or buffer shape so that the longer portions of the crescent shapes rest against the mattress of the baby crib and support the segments above the mattress while the shorter parts of the crescents and the short junction between adjacent crescents remains erect and forms lower openings between the crib mattress and the pad. These openings preferably coincide with the spacing of the balusters of the crib. These openings permit air to flow freely between the inside and outside of the crib at the surface of the crib mattress.

Also, because the crescent shapes are so narrow and closely spaced in the present invention, this prevents a baby from rolling over against a segment and having both its mouth and nose covered or blocked by one of the longer portions of the crescent shapes. This further reduces the chance that a baby could be suffocated by the present invention.

A further advantage of the present invention is that it is easy to manufacture and is an esthetically pleasing and marketable design.

SUMMARY OF THE INVENTION

The present invention is a baby crib pad with lower openings forming air gaps therein for use on a baby crib for the purpose of protecting a baby from bumping against the balusters of a baby crib while eliminating the dangers of the baby being strangled or suffocated by the pad and while allowing free air flow into and out of the crib to help prevent sudden infant death syndrome. More specifically, the present invention is a pad consisting of a plurality of separate segments so that each segment is provided with a padded portion that remains inside the crib to protect the baby from banging against the balusters of the crib.

The segments are tightly padded so that they stand erect above a crib mattress when secured to the balusters.

Each segment is provided with pairs of cooperating vertical flaps that extend around individual balusters of the baby crib and are tied to together on the outside of the crib via short tie fasteners that are provided on the vertical flaps.

The short tie fasteners are purposefully made short so that they can only be tied in a knot to the adjacent short tie fastener to tightly secure the segments of the pad to the crib. The vertical flaps hold the segments from top to bottom so securely so as to prevent a baby from getting its head between the pad and the balusters of the crib.

The lower border of the padded portion is compact crescent shield or buffer shaped so that the longer portions of the crescents rest against the mattress of the baby crib and support the pad above the matters and the shorter portions of the crescents and the junctions between adjacent crescents are raised above the mattress to thereby form lower openings in the pad which serve as air gaps between the shorter portions of the crescent shapes and the surface of the mattress, permitting air and heat to flow freely between the inside and outside of the crib. These lower openings also allow an adult to look through the openings in order to check on a baby without being observed by the baby and thereby preventing the baby from being awakened or otherwise disturbed. This is particularly useful when trying to get a baby to settle down for a nap.

DETAILED DESCRIPTION OF THE PREFERRED EMBODIMENT

Figure 1:
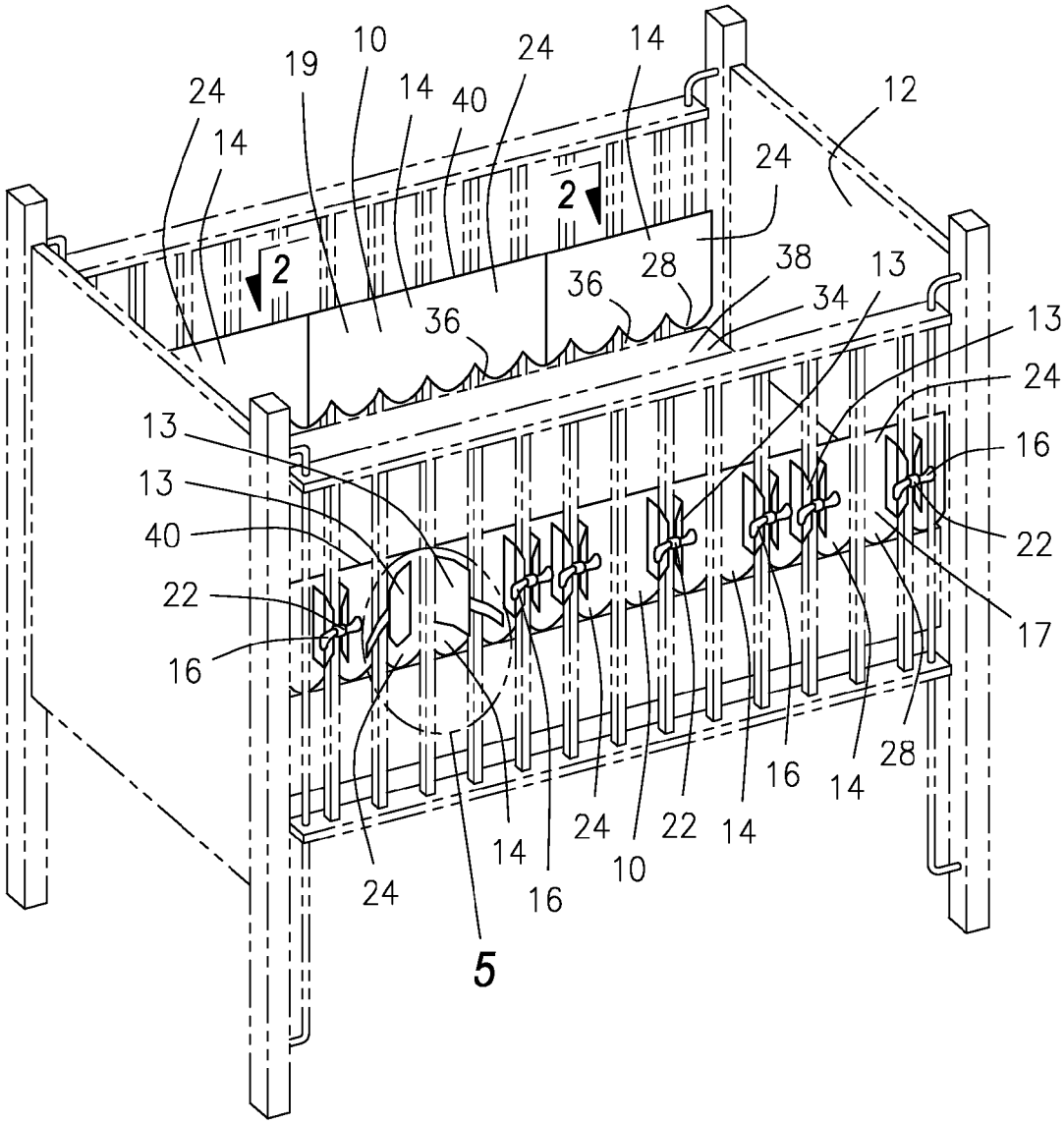
FIG. 1 is a perspective view of a baby crib to which is attached a baby crib pad with lower openings that is constructed in accordance with a preferred embodiment of the present invention.
Figure 2:
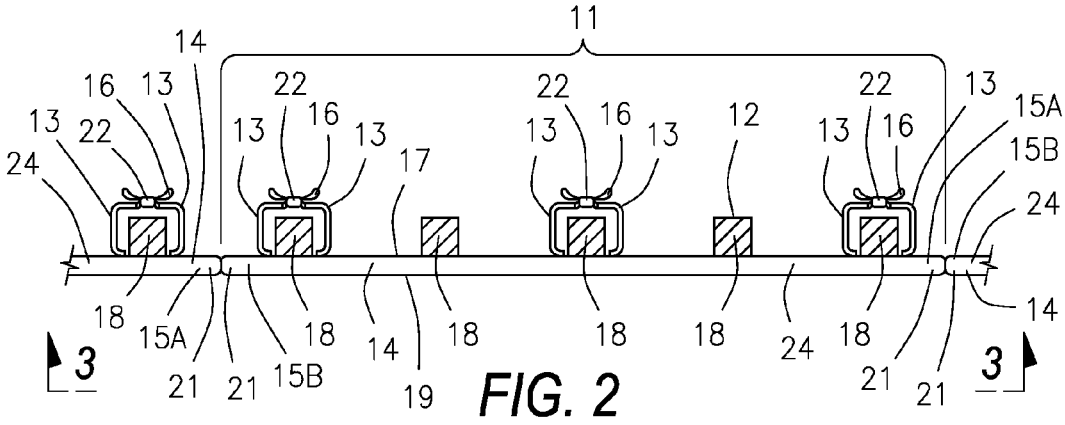
FIG. 2 is a cross sectional view taken along line 2-2 of FIG. 1.
Figure 3:
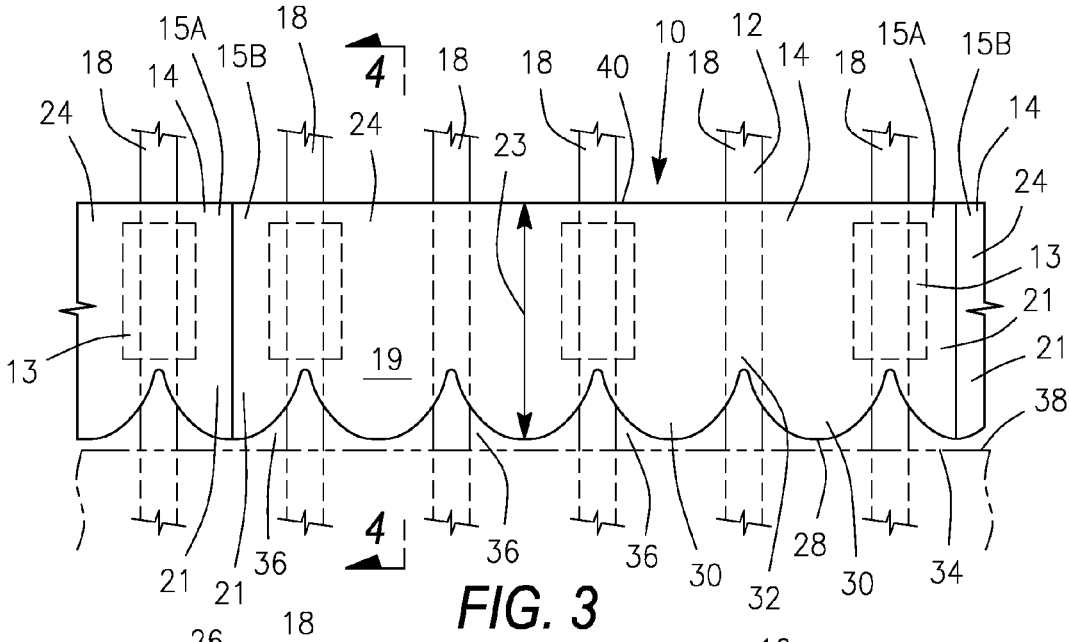
FIG. 3 is a front view taken along line 3-3 of FIG. 2.
Figure 4:
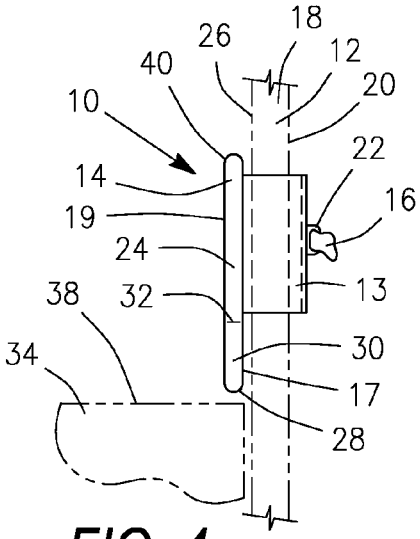
FIG. 4 is a cross sectional view taken along line 4-4 of FIG. 3.

Referring now to FIG. 1, there is illustrated a baby crib pad with lower openings 10 that is constructed in accordance with a preferred embodiment of the present invention. The pad 10 of FIG. 1 is shown in use on baby crib 12. As illustrated in FIGS. 2, 3, and 4, the pad 10 consisting of a plurality of separate stiffly padded segments 14 that are employed on the inside 26 of the crib 12 with ends 15A and 15B of the segments 14 touching each other in an end-to-end or abutting fashion. The padded segments 14 are provided with squared off ends 21, as best illustrated in FIGS. 2 and 3, which facilitates this abutting arrangement. As illustrated in FIG. 2 for one segment 14, the segments 14 may be of different overall lengths 11 so that different combinations of the segments 14 can be used for different sizes of cribs 12.

Figure 5:
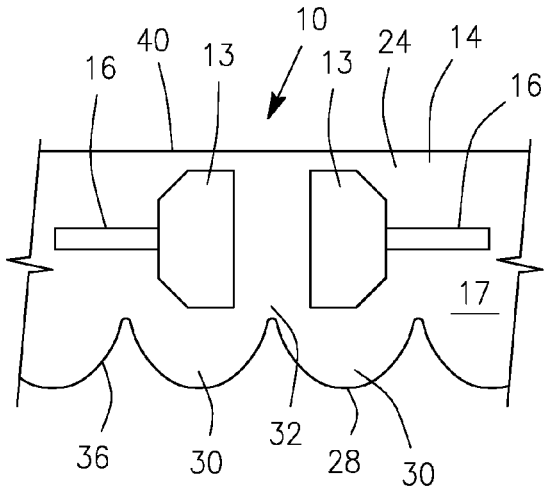
FIG. 5 is an enlarged rear view a portion of the pad contained within circle 5 of FIG. 1, shown removed from the crib.

Referring also to FIG. 5, each padded segment 14 is provided with a cooperating pairs of vertical flaps 13 located on its rear side 17, i.e. the side of the pad 10 that faces the balusters 18 and faces away from the crib mattress 34. The opposite front side 19 of the pad 10 faces a crib mattress 34 where the baby (not illustrated) will be located. Each vertical flap 13 is secured to the rear side 17 of the segment 14 and, when in use, extends around one or more of the balusters 18 of the crib 12 and is tied to the baluster 18 by short tie fasteners 16 that extend on the outside 20 of the baby crib 12. Tie fasteners 16 of adjacent cooperating pairs of vertical flaps 13 can be tied together in a knot 22 around the balusters 18 to secure the segments 14 of the pad 10 to the crib 12. Once they are thus secured to the balusters 18, the stiffly padded segments 14 stand erect adjacent to the balusters 18 of the crib 12. The tie fasteners 16 are specifically and purposefully designed to be only long enough to tie into a knot 22 to prevent the user from trying to tie them in some other manner which could then be more easily loosened and untied.

As shown in FIGS. 2 and 4, each segment 14 is provided with a stiffly padded portion 24 that remains on the inside 26 of the crib 12 to protect the baby that occupies the crib 12 from banging against the balusters 18 of the crib 12. Referring also to FIG. 3, a compact and repeating crescent shield or buffer shaped lower border 28 of the padded portion 24 is provided with longer portions 30 and shorter portions 32 where the adjacent crescent shapes join so that a shorter portion 32 is located between adjacent longer portions 30.

As best illustrated in FIGS. 3 and 5, the present invention improves over prior art designs by making the lower portion of the pad 10 a continuously repeating series of u-shaped crescents 28 that touch each other and with the junction between adjacent abutting crescents 28 forming the openings 36 with the crib mattress 34. Because the crescents 28 touch each other, they join each other in as continuous repeating fashion so that the openings 36 formed between the crescents 28 form a pad with a larger proportions of opening area to pad area at the surface of the crib mattress 34. In fact the opening area to pad area ratio for the present invention exceeds 1 to 4.

The spacing of the crescent shapes preferably coincides with the spacing of the balusters 18 of the crib 12. This spacing is illustrated in FIG. 3 which illustrated the location of the shorter portions 32 of the crescent shaped border 28 coinciding with the location of the balusters 18. Although not illustrated, it is obvious that the pad 10 could instead be made so that the location of the longer portions 30 would coincide with the location of the balusters 18 or made so that neither the location of the shorter portions 32 nor the location of the longer portions 30 would coincide with the location of the balusters 18.

The longer portions 30 of the repeating crescent shaped border 28 can only slide down on the balusters 18 until the longer portions 30 rest against the mattress 34 of the baby crib 12, as best seen in FIG. 3. Because of the stiff padding provided in the padded portion 23, the padded portion 23 is semi-rigid and resists bending or sagging which allows the pad 10 to be supported upon the mattress 34 via the longer portions 30. Because the padded portion is so tightly padded, it will stand erect above the mattress 34, thus holding the shorter portions 32 of the repeating crescent shaped border 28 above the mattress 34 and forming lower openings 36 which serve as air gaps between the mattress 34 and the shorter portions 32 of the padded portion 24. These lower openings 36 permit air to flow freely between the inside 26 and outside 20 of the crib 12 at the upper surface 38 of the mattress 34 and allow an adult to visually check on the baby while the presence of the adult remains undetected by the baby.

Because the tie fasteners 16 are short, once they have been tied together into a knot 22 around one or more balusters 12, they are not easily untied. This makes it unlikely that the tie fasteners 16 could be untied by either a baby or toddler. Also, as illustrated in FIG. 3, the height 23 of the padded portion 24 is sufficient to prevent a baby from reaching the tie fasteners 16. Because the tie fasteners 16 are located on the outside 20 the crib 12 and because the tie fasteners 16 are located approximately half way between an upper border 40 of the padded portion 24 and the lower compact crescent shield or buffer shaped border 28 of the padded portion 24, it is unlikely that a baby located within the crib 12 could even manage to reach the knots 22 formed in the tie fasteners 16, let alone untie them. Also, because each segment 14 is tied to the balusters 18 at close intervals and because the vertical flaps 13 hold the padded portion 24 securely to the balusters from top-to-bottom of the padded portion 24, this serves as a deterrent against the baby getting its head in between the segments 14 of the pad 10 and the balusters 18 where the baby could be trapped or suffocated.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A baby crib pad with lower openings comprising: at least two padded segments attachable to a baby crib so that each of the padded segments are located on the inside of a crib adjacent the crib's balusters, and each segment provided with a lower border that is a continuously repeating series of u-shaped crescents so that lower portions of the crescents rest on and support the segments above a crib mattress and upper portions of the crescents that are located at the junction of adjacent abutting crescents form lower openings with the crib mattress, and at least one pair of cooperating vertical flaps attached to and extending substantially along the rear side of each padded segment as a means of attaching the padded segments to the balusters of the crib.

2. A baby crib pad with lower openings according to claim 1 further comprising:

at least one fastener provided on each vertical flap so that fasteners on adjacent cooperating vertical flaps can be extended around balusters of a baby crib and secured together on the outside of the crib as a means of attaching the padded segments to the balusters of the crib.

3. A baby crib pad with lower openings according to claim 2 wherein the fasteners are attached to each of the vertical flaps approximately half way between an upper border of the padded segment and the lower border of the padded segment.

4. A baby crib pad with lower openings according to claim 2 wherein the crescent lower border has an opening area to pad area ratio in excess of 1 to 4.

5. A baby crib pad with lower openings according to claim 2 further comprising:

stiff padding provided in the padded segments making the segments semi-rigid and resistant to bending and sagging so that they are able to be supported upon the mattress via the longer portions of the u-shaped crescents.

6. A baby crib pad with lower openings according to claim 2 further comprising:

said padded segments being of different lengths so that different combinations of the segments can be used for different sizes of cribs.

7. A baby crib pad with lower openings according to claim 2 further comprising:

squared off ends provided on each of the padded segments so that the padded segments can be arranged inside the crib with their ends abutting the ends of adjacent segments.

8. A baby crib pad with lower openings comprising: at least one padded segment attachable to a baby crib so that each of the padded segments are located on the inside of a crib adjacent the crib's balusters, and each segment provided with a lower border that is a continuously repeating series of u-shaped crescents so that lower portions of the crescents rest on and support the segments above a crib mattress and upper portions of the crescents that are located at the junction of adjacent abutting crescents form lower openings with the crib mattress, and at least one pair of cooperating vertical flaps attached to and extending substantially along the rear side of each padded segment as a means of attaching the padded segments to the balusters of the crib.

9. A baby crib pad with lower openings according to claim 8 further comprising:

at least one fastener provided on each vertical flap so that fasteners on adjacent cooperating vertical flaps can be extended around balusters of a baby crib and secured together on the outside of the crib as a means of attaching the padded segments to the balusters of the crib.

10. A baby crib pad with lower openings according to claim 9 wherein the fasteners are attached to each of the vertical flaps approximately half way between an upper border of the padded segment and the lower border of the padded segment.

11. A baby crib pad with lower openings according to claim 10 wherein the crescent lower border has an opening area to pad area ratio in excess of 1 to 4.

12. A baby crib pad with lower openings according to claim 10 further comprising:

stiff padding provided in the padded segments making the segments semi-rigid and resistant to bending and sagging so that they are able to be supported upon the mattress via the longer portions of the u-shaped crescents.

13. A baby crib pad with lower openings according to claim 10 further comprising:

said padded segments being of different lengths so that different combinations of the segments can be used for different sizes of cribs.

14. A baby crib pad with lower openings according to claim 10 further comprising:

squared off ends provided on each of the padded segments so that the padded segments can be arranged inside the crib with their ends abutting the ends of adjacent segments.

* * * * *